United States Patent [19]

Neu et al.

[11] Patent Number: 4,665,966

[45] Date of Patent: May 19, 1987

[54] RISER SLEEVES FOR METAL CASTING MOULDS

[75] Inventors: Max G. Neu, Lichfield; Michael J. Gough, Gnosall; Michael C. Ashton; Roger Wallis, both of Sheffield, all of England

[73] Assignees: Foseco International Limited; Steel Castings Research and Trade Association, both of Birmingham, England

[21] Appl. No.: 864,853

[22] Filed: May 20, 1986

[30] Foreign Application Priority Data

Jun. 10, 1985 [GB] United Kingdom ..... 8514647

[51] Int. Cl.[4] ..... B22D 33/04

[52] U.S. Cl. ..... 164/137; 164/359; 164/360

[58] Field of Search ..... 164/122, 123, 137, 359, 164/360, 363, 364

[56] References Cited

U.S. PATENT DOCUMENTS

| | | | |
|---|---|---|---|
| 3,456,914 | 7/1969 | Konrad et al. | 249/201 |
| 3,467,173 | 9/1969 | Tisdale, Jr. | 164/359 |
| 3,815,655 | 6/1974 | Baur | 164/359 |
| 4,423,762 | 1/1984 | Trinkl et al. | 164/360 |
| 4,467,858 | 8/1984 | Trinkl et al. | 164/360 |
| 4,574,869 | 3/1986 | Trinkl et al. | 164/360 |

FOREIGN PATENT DOCUMENTS

| | | | |
|---|---|---|---|
| 2803247 | 7/1979 | Fed. Rep. of Germany | 164/359 |
| 1461842 | 1/1977 | United Kingdom . | |
| 2141649A | 1/1985 | United Kingdom . | |

*Primary Examiner*—Nicholas P. Godici
*Assistant Examiner*—Richard K. Seidel
*Attorney, Agent, or Firm*—Nixon & Vanderhye

[57] ABSTRACT

A riser sleeve has at its end which is uppermost when the sleeve is located in the mould a holding member which can be engaged by a mechanical holding device so as to adapt the sleeve to automatic handling. The holding member may be for example a disc, ring or solid or hollow cylinder and may be formed integrally with the sleeve or formed separately and fixed to the sleeve. By adopting a standard shape and size for the holding member for a wide range of sleeve shapes and sizes the same holding device can be used to handle the whole range of sleeves.

12 Claims, 13 Drawing Figures

RISER SLEEVES FOR METAL CASTING MOULDS

Figure 1:
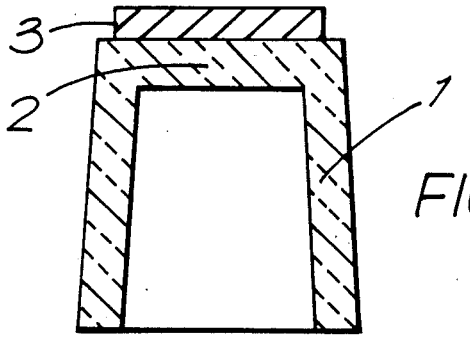

This invention relates to riser sleeves for use in metal casting moulds.

During solidification cast metals undergo a reduction in their volume. For this reason, in the casting of molten metals into moulds it is usually necessary to employ risers or feeder heads located above or at the side of the castings in order to compensate for the shrinkage which occurs when the castings solidify. It is common practice to surround a riser with an exothermic and/or thermally insulating riser sleeve in order to retain the riser metal in the molten state for as long as possible, and thereby to improve the feeding effect and to enable the riser volume to be reduced to a minimum.

Due to increased automation of existing methods for making moulds and the introduction of new mould making processes which are adaptable to being automated, and the desire to further reduce casting production costs, there is a need to automate that part of the mould making process in which location of the riser sleeve takes place.

However, conventional riser sleeves are not readily adaptable to automatic handling because in practice a variety of different sleeve shapes and sizes are used.

According to the invention there is provided a riser sleeve for use in a metal casting mould characterised in that the sleeve has at its end which is uppermost when the sleeve is located in the mould a holding member capable of being engaged by a mechanical holding device.

Any type of riser sleeve may be modified so as to have a holding member in accordance with the invention. For example the sleeve may be of circular or oval cross-section, it may have parallel walls, its inner and/or its outer surface may taper from one end to the other, and it may be open at both ends or it may be closed at one end by an integral or separately formed cover, which may be for example flat or domed.

The holding member may be formed integrally with the sleeve, for example with the wall of an open-ended sleeve or with the top of a closed sleeve, or the holding member may be formed separately and attached to the sleeve for example by an adhesive or by mechanical means such as staples or nails.

The shape and dimensions of the holding member may vary widely and may be chosen to suit the design of the mechanical holding device with which it is to be used. In practice simple shapes such as discs, rings or solid or hollow cylinders are preferred and it is also preferable to adopt a standard shape and size so that the same holding member design can be used with a wide range of sleeve shapes and sizes. The same mechanical holding device can then be used to handle all such sleeves.

The holding member may be made from the same material as that of the sleeve, or the holding member may be made from a different material from the sleeve, the choice sometimes being independent on the type of mould making process in which the sleeve is to be used.

For example, when exothermic, heat-insulating or exothermic and heat-insulating sleeves are incorporated automatically into sand moulds by location of the sleeves on supports on pattern plates the holding member may be made from bonded particulate material such as sand or from a similar material to that of the sleeve.

For other applications such as investment casting, where the sleeve is fixed to a wax pattern, a ceramic shell mould is formed around the pattern, and the mould is heated to remove the wax and then fired to harden and strengthen the ceramic material, or in the production of a ceramic shell mould using a polystyrene pattern where the sleeve is fixed to a polystyrene pattern or the sleeve is inserted in a die and polystyrene is injected into the sleeve prior to formation of the ceramic shell, both the sleeve and the holding member must be made of materials which are capable of withstanding the high temperatures involved in the mould making processes.

When the sleeve is incorporated into a ceramic shell mould as described above it may be desirable to design the holding member in such a way that the mould can be lifted and handled by a second mechanical holding device, for example during passage of the mould through a firing kiln. This can be achieved for example by providing a flange on the holding member or by using a holding member whose outer perimeter extends beyond the outer perimeter of the riser sleeve.

The invention also includes a method of making a metal casting mould in which a riser sleeve is incorporated into the mould during or after its production by means of a mechanical holding device which engages with a holding member formed integrally with or attached to that end of the sleeve which is to be uppermost when the sleeve is located in the mould.

The sleeves of the invention are not only suitable for use in automated methods of casting mould production but they can also be designed so as to facilitate mechanical handling of the castings produced in the moulds. This can be achieved either by means of the design of the holding member or by incorporating an additional feature into the design of the sleeve itself.

For example, when the holding member on an open-ended sleeve is a ring or hollow cylinder the inner diameter of the ring or hollow cylinder will correspond to the diameter of the top portion of the riser when metal is cast into the mould. By using a holding member of the same dimensions on a range of sleeves of different shapes and sizes it is possible to produce casting risers whose top portion has a constant diameter thus enabling a wide range of castings to be handled mechanically by locating a given holding device on the riser of each of the castings.

By making the inner perimeter of the riser sleeve below the holding member the same shape and dimensions as the outer perimeter of the holding member it is possible to utilise the same mechanical holding device both for incorporating the sleeve in a mould and for handling the casting after production.

The invention is illustrated with reference to the accompanying drawings in which all of FIGS. 1–13 are vertical cross-sections through riser sleeves according to the invention.

In the embodiment of FIG. 1 a riser sleeve 1 having a closed top 2 and which tapers outwardly from top to bottom has a holding member in the form of a disc 3 fixed to its top 2. The diameter and height of the disc 3 are so chosen that a mechanical holding device can engage with the disc 3 in order to hold the sleeve 1 and place the sleeve 1 on a pattern for forming a metal casting mould, in a die for forming a pattern in the sleeve or in a metal casting mould itself.

Figure 2:
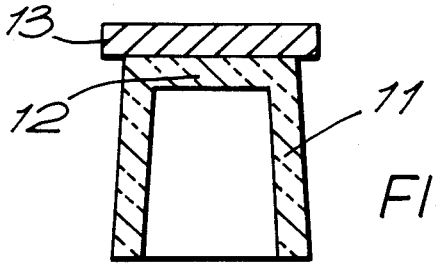

In FIG. 2 a riser sleeve 11 of similar shape but smaller in size than the sleeve 1 in FIG. 1 has fixed to its top 12 a holding member in the form of a disc 13 of the same dimensions as the disc 3 in FIG. 1. Since the two discs 3 and 13 are of the same size they can both be held by the same mechanical holding device thus enabling the same device to be used for making moulds for which the requirements for feeding castings produced in the moulds are such that different size riser sleeves are needed.

Figure 3:
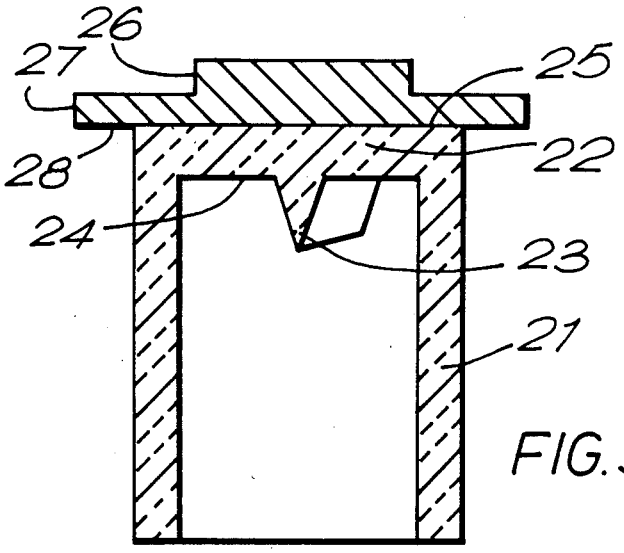

In FIG. 3 a riser sleeve 21 has a closed top 22 and a wedge-shaped Williams core 23 formed integrally with the inner surface 24 of the top 22 and extending across a diameter of the sleeve 21 over the full inner surface 24. The sleeve 21 also has fixed to the outer surface 25 of its top 22 a holding member in the form of a disc 26 having a flange 27. The diameter of the disc 26 and its height above the flange 27 are the same as the diameters and heights of the discs 3 and 13 in FIGS. 1 and 2 respectively so the same mechanical holding device which is used for holding the riser sleeves in FIGS. 1 and 2 can engage with the disc 26 and hold the riser sleeve 21. Flange 27 extends beyond the outer perimeter of the riser sleeve 21 so that if desired, after the sleeve 21 has been incorporated in a ceramic shell mould by locating the sleeve 21 on a pattern, forming the ceramic shell mould around the pattern and removing the pattern, the sleeve 21 and ceramic shell mould assembly can be lifted by engaging lifting means with the underside 28 of the flange 27.

Figure 4:
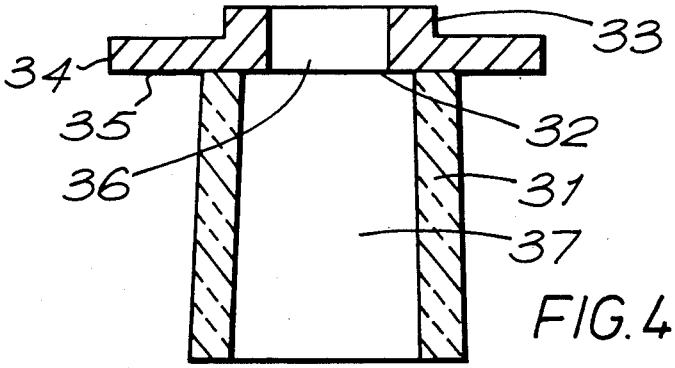

FIG. 4 shows a tapered riser sleeve 31 having an open top 32 and fixed to the top 32 a holding member in the form of a ring 33 having a flange 34. The outer diameter of the ring 33 and its height above the flange 34 are the same as the diameters and heights of the discs in FIGS. 1–3 and the riser sleeve 31 can be held by the same mechanical holding device as is used to hold the sleeves in FIGS. 1–3. The flange 34 extends beyond the perimeter of the riser sleeve 31 so that if desired the sleeve 31 can also be lifted by means engaging with the underside 35 of the flange 34. Aperture 36 in the ring 33 ensures that when metal is cast into a mould containing the riser sleeve 31 contact between cavity 37 in the sleeve 31 and the atmosphere is still maintained. After the metal has been cast the riser sleeve 31 and the ring 33 are removed from the riser formed in the aperture 36 and the cavity 37, and the top portion of the riser which had solidified in aperture 36 can be used for locating a holding device for mechanical handling of the casting.

Figure 5:
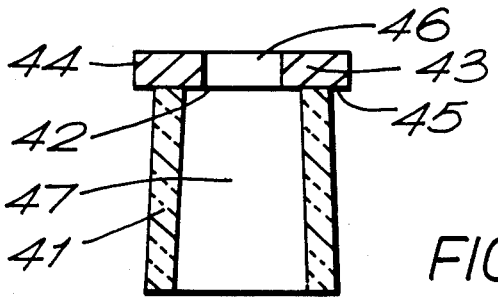

In FIG. 5 a riser sleeve 41 has fixed to its top 42 a holding member in the form of a ring 43. The outside diameter and height of the ring 43 are the same as the diameters and heights of the discs in FIGS. 1–3 and the ring in FIG. 4. The outside edge 44 of the ring 43 extends beyond the perimeter of the sleeve 41 so that if desired the sleeve 41 can be lifted by engagement with the underside 45 of the protruding edge 44. After metal has been cast into a mould containing the riser sleeve 41 the sleeve and the ring 43 are removed from the riser formed in aperture 46 and cavity 47, and the top portion of the riser which had solidified in aperture 46 can be used for locating a holding device for mechanical handling of the casting.

Figure 6:
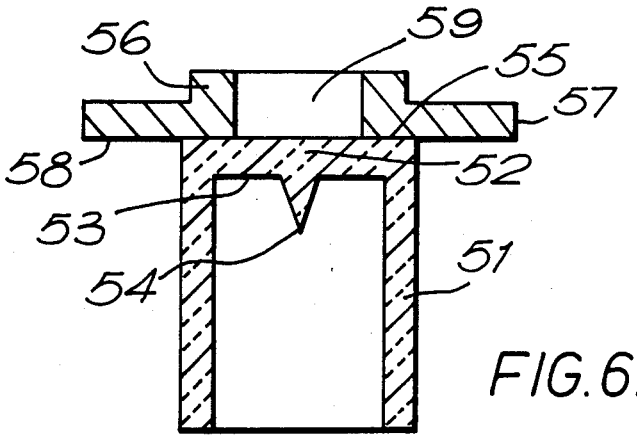

FIG. 6 shows a riser sleeve 51 having a closed top 52 and formed integrally with the inner surface 53 of the top 52 a conical Williams core 54. Sleeve 51 also has fixed to the outer surface 55 of the top 52 a holding member in the form of a ring 56 having a flange 57, both the ring 56 and the flange 57 having the same dimensions as the ring 33 and flange 34 of FIG. 4. The flange 57 extends beyond the perimeter of the sleeve 51 and if desired the sleeve can be lifted by engagement with the underside 58 of the flange 57. Aperture 59 in the ring 56 serves no function when the sleeve 51 is used for producing a metal casting but it is convenient to make the holding member of such a form that it is applicable to both open and closed top sleeves.

Figure 7:
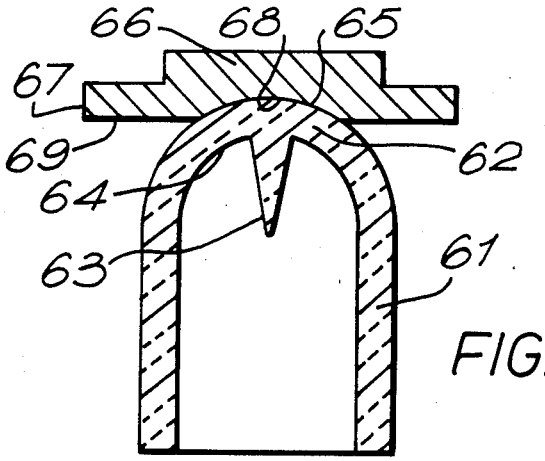

In FIG. 7 a riser sleeve 61 has a domed top 62 and a conical Williams core 63 formed with the inner surface 64 of the domed top 62. The sleeve 61 also has a holding member fixed to the outer surface 65 of the domed top 62 in the form of a disc 66 having a flange 67 and a concave recess 68 in its base into which the domed top 62 fits. The sleeve 61 can be held by a mechanical holding device engaged with the disc 66 and the sleeve can also be lifted by means engaging with the underside 69 of the flange 67.

Figure 8:
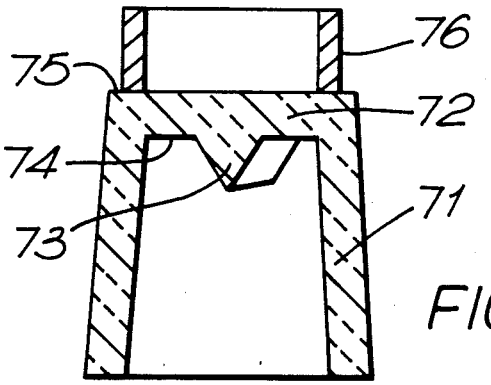

FIG. 8 shows a riser sleeve 71 having a flat top 72 and a wedge-shaped Williams core 73 formed integrally with the inner surface 74 at the top 72 and extending across a diameter of the sleeve 71 over the full inner surface 74. The sleeve 71 also has fixed to the outer surface 75 of its top 72 a holding member in the form of a hollow cylinder 76 which can be engaged by a mechanical holding device.

Although FIGS. 1–8 show examples of riser sleeves according to the invention having holding members which are formed separately from and fixed to the sleeves, in each case the same design of riser sleeve can be achieved by integrally forming the sleeve and the holding member, thus eliminating the need to fix together the sleeve and the holding member using an adhesive, staples or nails or other similar fixing means.

Figure 9:
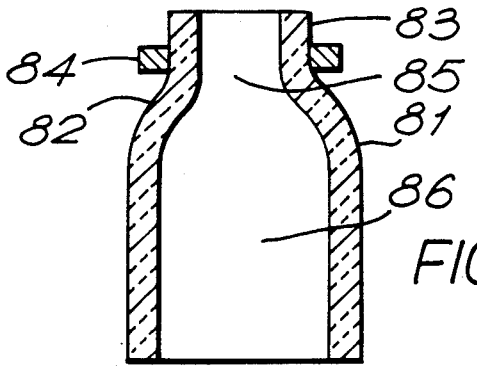

In FIG. 9 a riser sleeve 81 has an arcuate wall at its top 82 and formed integrally therewith a holding member in the form of a hollow cylinder 83 which can be engaged by a mechanical holding device. If desired the outside of the hollow cylinder 83 adjacent the top 82 of the sleeve 81 can be provided with a flange 84 as shown in the drawing, thus enabling a mould in which the sleeve 81 is incorporated to be lifted and handled by a second mechanical holding device which engages with the flange. After metal has been cast into a mould containing the riser sleeve 81 the sleeve 81 and the integral hollow cylinder 83 are removed from the riser formed in hollow cylinder cavity 85 and sleeve cavity 86, and the top portion of the riser which had solidified in the cylinder cavity 85 can be used for locating a holding device for mechanical handling of the casting.

Figure 10:
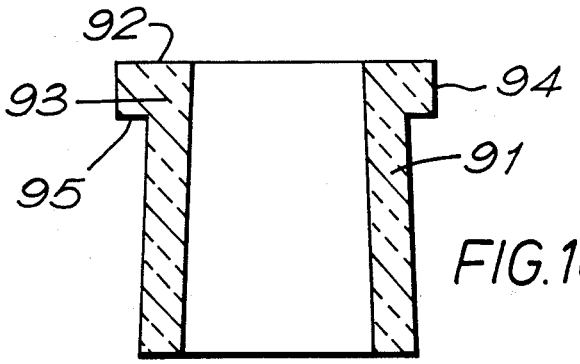

FIG. 10 shows an open-ended riser sleeve 91 whose top end 92 has a larger outside diameter and larger wall thickness than the remainder of the sleeve so as to form an integral holding member in the form of a disc 93 having a flange 94. A mechanical holding device can engage with the underside 95 of the flange 94.

Figure 11:
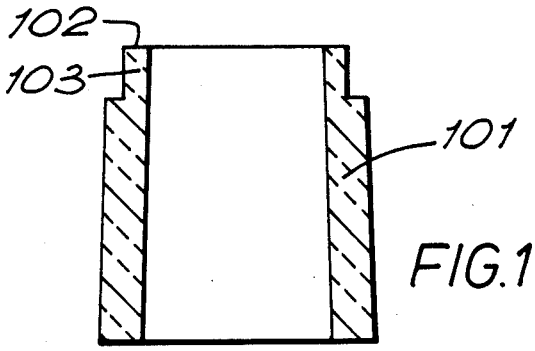

FIG. 11 shows an open-ended riser sleeve 101 whose top and 102 has a smaller outside diameter and smaller wall thickness than the remainder of the sleeve so as to form an integral holding member in the form of a disc 103.

Figure 12:
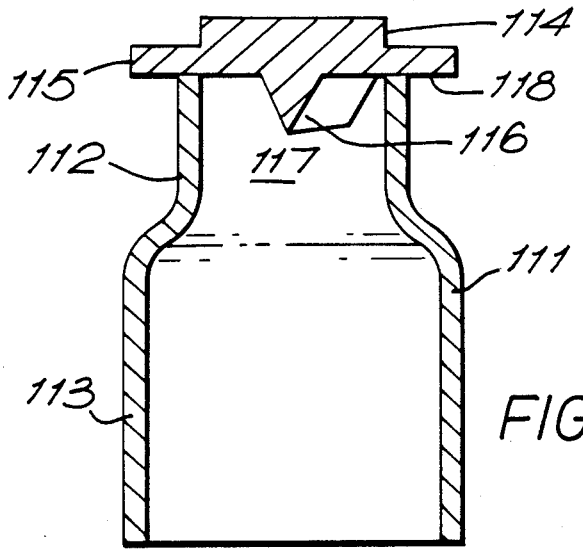

In FIG. 12 a riser sleeve 111 has a top portion 112 and a bottom portion 113, and fixed to the top of the top portion 112 a holding member in the form of a disc 114 having a flange 115. The underside of the holding member has integrally formed therewith a wedgeshaped Williams core 116 projecting into cavity 117 in the top portion 112. In use a mechanical holding device can engage with the disc 114 in order to hold the sleeve 111 when the sleeve 111 is incorporated into a mould. The flange 115 extends beyond the perimeter of the top portion 112 of the sleeve 111 so that if desired, for example after the sleeve has been incorporated in the mould, the sleeve 111 and mould assembly can be lifted by engaging lifting means with the underside 118 of the flange 115. After metal has been cast into a mould containing the sleeve 111 the sleeve 111 can be removed from the riser formed inside the sleeve 111, and because the diameter of the disc 114 and the inner diameter of the top portion 112 of the sleeve 111 are the same, the casting can then be handled mechanically by engaging the same holding device as was used during production of the mould with the top portion of the riser which had solidified in the cavity 117. As shown in FIG. 12 the diameter of the body portion of the sleeve is larger than that of the top portion. The embodiment shown can be modified so that the diameter of the body portion is smaller than that of the top portion. By standardising the diameter of the disc and the inner diameter of the top portion of the riser sleeve it is therefore possible to utilise a particular mechanical holding device with sleeves in which the diameter of the bottom portion varies over a wide range.

Figure 13:
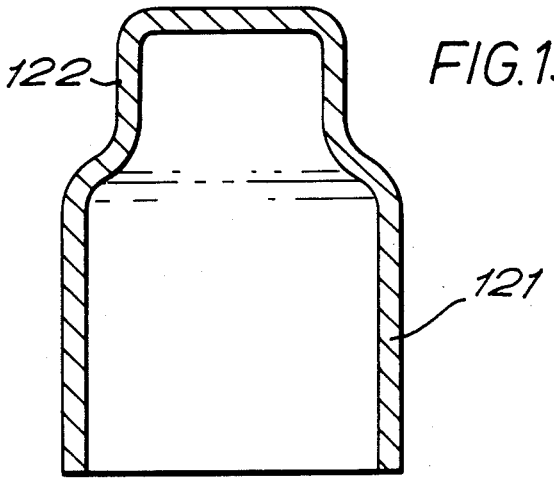

FIG. 13 shows a bottle-shaped riser sleeve 121 having a closed top or neck portion 122 and in which the neck portion 122 constitutes a holding member with which a mechanical holding device can engage in order to hold the sleeve 121 when the sleeve 121 is incorporated in a mould. After metal has been cast into a mould containing the sleeve 121 the sleeve 121 can be removed from the riser formed within the sleeve 121, and the casting can then be handled mechanically by engaging a holding device with the top portion of the riser.

We claim:

1. A method of making metal casting moulds in which a riser sleeve is incorporated into each mould during or after production of the moulds, the method comprising the steps of providing a plurality of riser sleeves of different sizes for contact with molten metal and a plurality of holding members of a like predetermined size and shape, connecting each said holding member with a respective one of said riser sleeves at the ends of the sleeves which are to be uppermost in the moulds such that each holding member is connected with a riser sleeve of a different size, engaging with the holding members a mechanical holding device, and incorporating each riser sleeve in a mould by means of the mechanical holding device.

2. A method according to claim 1 including forming at least one of said holding members integral with its connected sleeve.

3. A method according to claim 1 including forming at least one of said holding members separately of its connected sleeve and subsequently attaching said one holding member and said connected sleeve one to the other.

4. A method of forming riser sleeves for use in metal casting moulds comprising the steps of:

providing a plurality of holding members of a like predetermined shape and size;

providing a plurality of riser sleeves of different sizes for contact with molten metal; and connecting each said holding member with a respective one of said riser sleeves at the ends of the sleeves which are to be uppermost in the moulds such that each holding member is connected with a riser sleeve of a different size.

5. A method according to claim 4 including forming at least one of said holding members integral with its connected sleeve.

6. A method according to claim 4 including forming at least one of said holding members separately of its connected sleeve and subsequently attaching said one holding member and said associated sleeve one to the other.

7. A method according to claim 4 wherein the holding members are one of a disc, a ring, a solid or a hollow cylinder.

8. A method according to claim 4 wherein each of said holding members has an outer periphery which extends beyond the perimeter of its connected sleeve.

9. A method according to claim 4 wherein each of said holding members is circular and a sleeve connected to one of said holding members being non-circular.

10. A method according to claim 4 wherein each of said holding members is circular and a sleeve connected to one of said holding members is circular.

11. A method according to claim 4 including closing one end of one of said sleeves by a cover.

12. A method according to claim 4 including the step of forming at least one of the holding members with a flange.

* * * * *